US011280472B2

(12) United States Patent
Balaj et al.

(10) Patent No.: US 11,280,472 B2
(45) Date of Patent: Mar. 22, 2022

(54) MODULAR LIGHTING SYSTEM

(71) Applicant: HELLA GmbH & Ko KGaA, Lippstadt (DE)

(72) Inventors: Ovidiu Petru Balaj, Sat Ilia (RO); Remus Pompiliu Dinu, Timisoara (RO); Marius Nicolae Dragomir, Timisoara (RO); Adrian Ciprian Firu, Timisoara (RO); Adrian Emanuel Maghet, Lugoj (RO); Florin Ovidiu Matei, Timisoara (RO); Ovidiu Cristian Pardut, Dumbravita (RO); Gabriel Sirbu, Costeiu (RO); George Cristian Oproiu, Craiova (RO)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/222,469

(22) Filed: Apr. 5, 2021

(65) Prior Publication Data

US 2021/0247047 A1 Aug. 12, 2021

Related U.S. Application Data

(63) Continuation of application No. PCT/EP2018/077144, filed on Oct. 5, 2018.

(51) Int. Cl.

| | |
|---|---|
| ***F21V 29/70*** | (2015.01) |
| ***F21S 2/00*** | (2016.01) |
| ***F21V 23/00*** | (2015.01) |
| ***F21Y 115/10*** | (2016.01) |
| ***F21V 5/04*** | (2006.01) |

(52) U.S. Cl.
CPC ..... *F21V 5/04* (2013.01); *F21S 2/005* (2013.01); *F21V 23/003* (2013.01); *F21V 23/006* (2013.01); *F21V 29/70* (2015.01); *F21Y 2115/10* (2016.08)

(58) Field of Classification Search
None
See application file for complete search history.

(56) References Cited

U.S. PATENT DOCUMENTS

| | | | | |
|---|---|---|---|---|
| 2009/0316403 | A1 | 12/2009 | Zhang et al. | |
| 2014/0003049 | A1* | 1/2014 | Ishida | F21K 9/60 362/244 |
| 2015/0023015 | A1 | 1/2015 | Ishida et al. | |
| 2018/0187880 | A1 | 7/2018 | Liu et al. | |

FOREIGN PATENT DOCUMENTS

| | | | |
|---|---|---|---|
| EP | 2149743 | A1 | 2/2010 |
| EP | 2690346 | A1 | 1/2014 |

OTHER PUBLICATIONS

International Search Report dated Dec. 11, 2018 in corresponding application PCT/EP2018/077144.

* cited by examiner

*Primary Examiner* — Britt D Hanley
(74) *Attorney, Agent, or Firm* — Muncy, Geissler, Olds & Lowe, P.C.

(57) ABSTRACT

A modular lighting system and method having a control PCB, an LED and a housing with a housing base. The LED is attached to a module PCB, wherein the LED and the module PCB are part of an LED module, wherein the module PCB of the LED module is electrically connected to the control PCB.

8 Claims, 12 Drawing Sheets

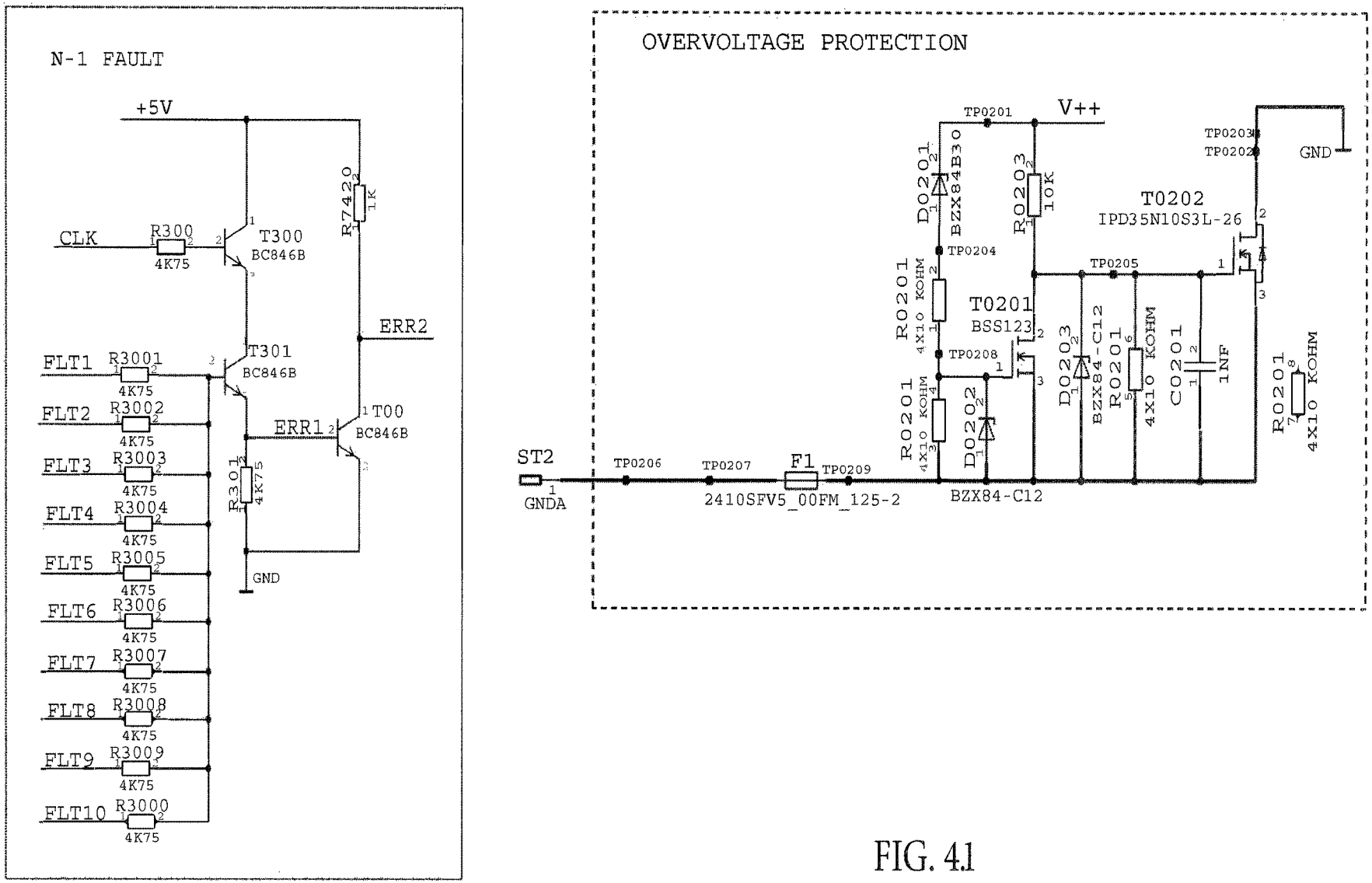
FIG. 4.1

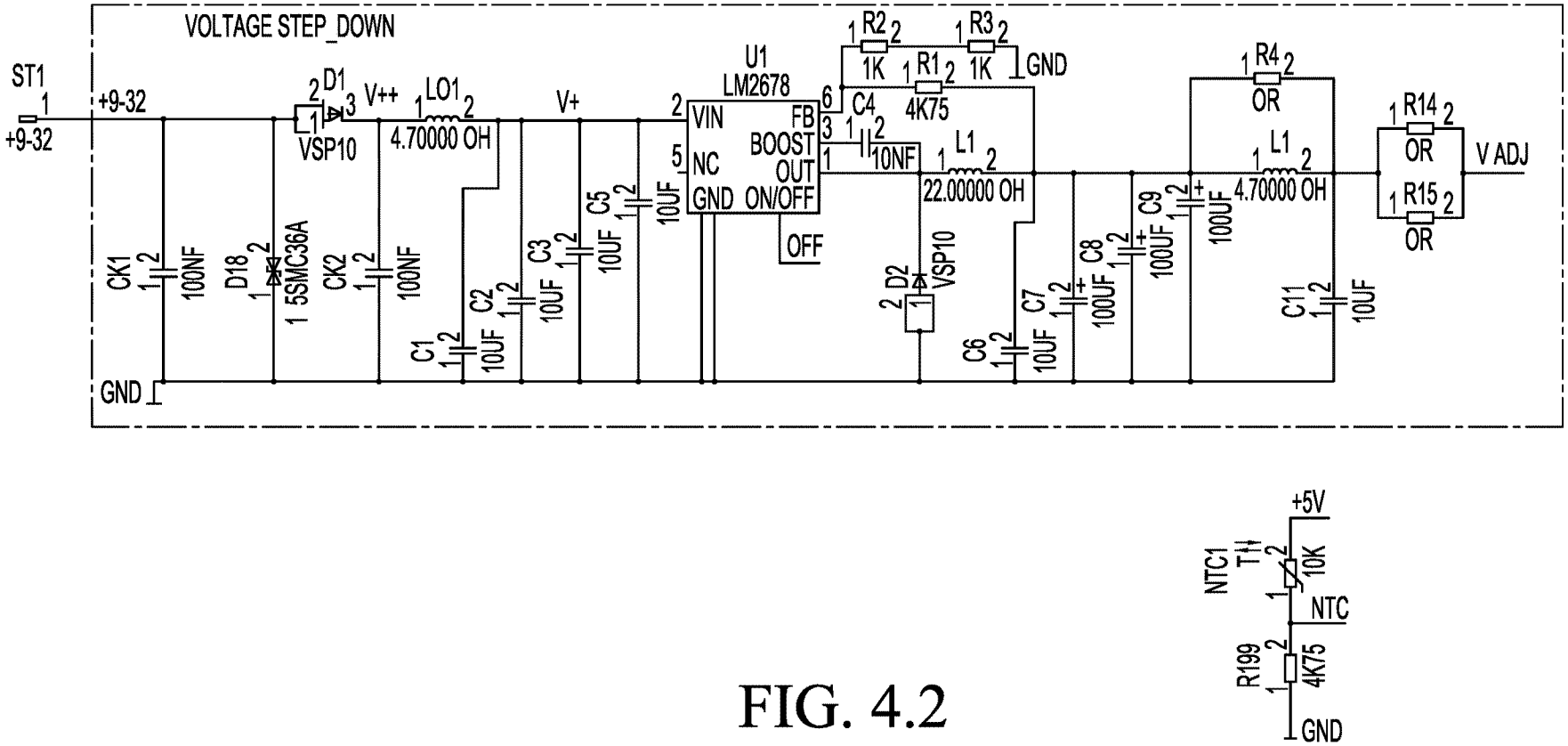
FIG. 4.2

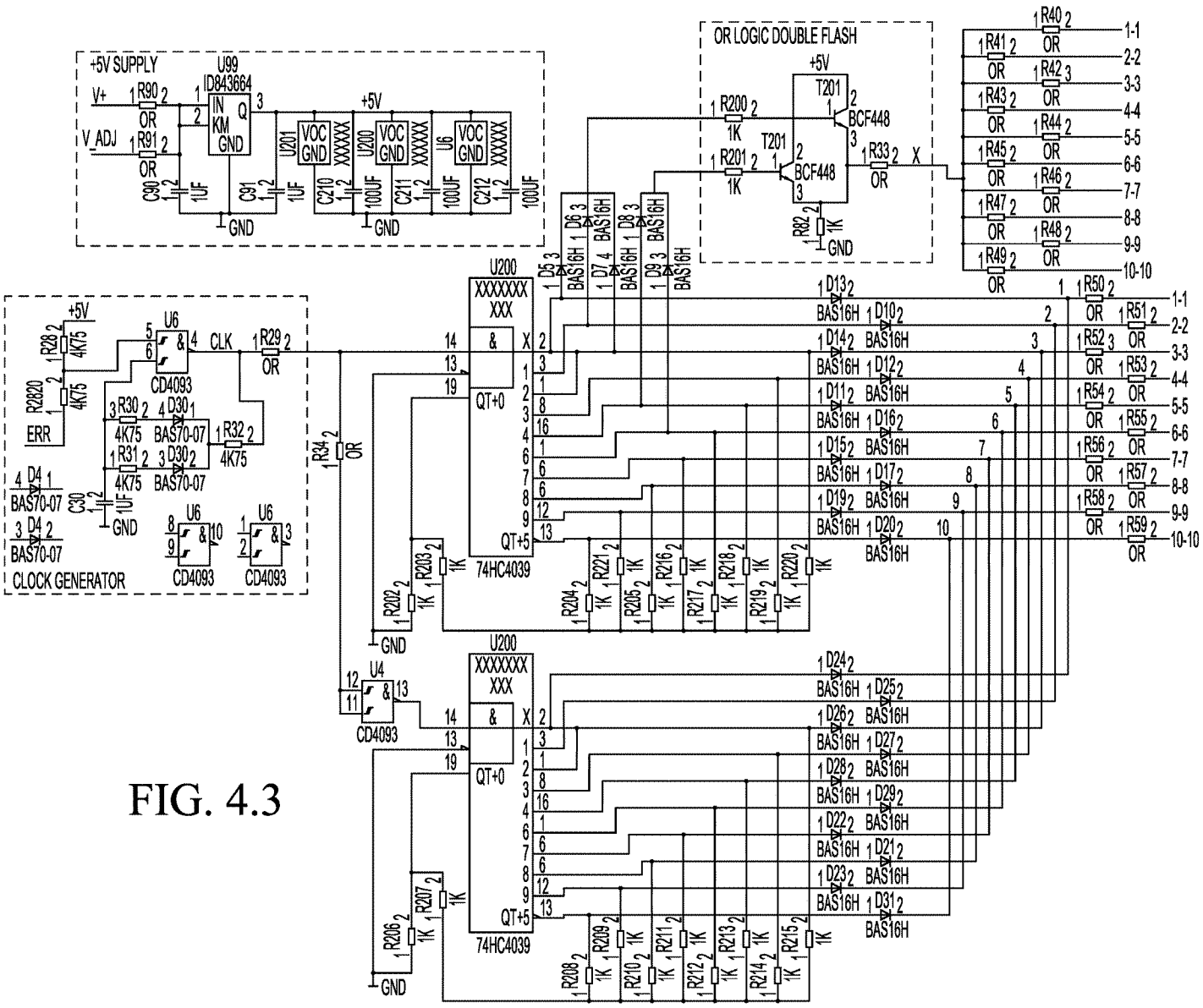
FIG. 4.3

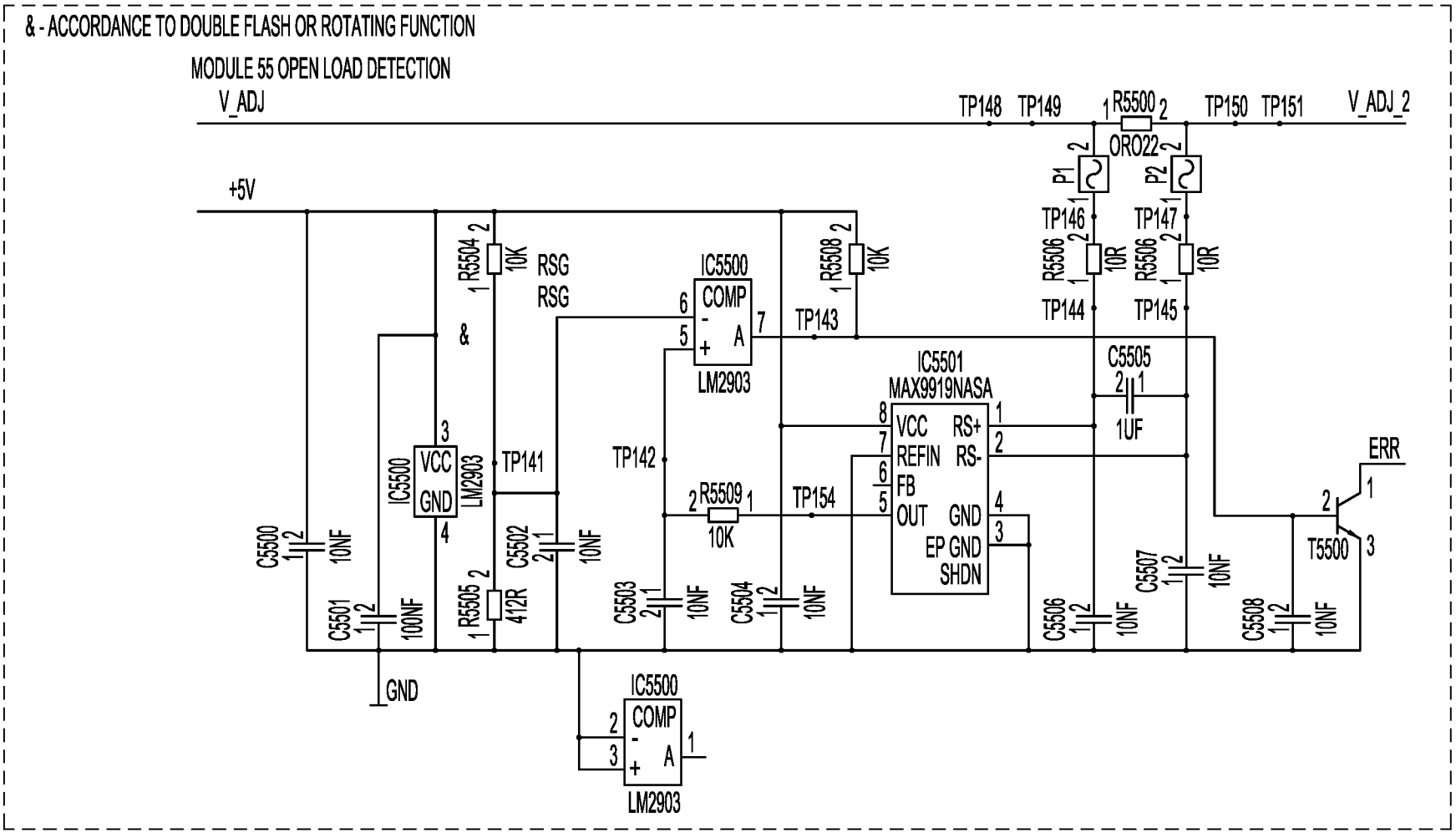
FIG. 4.4

MODULAR LIGHTING SYSTEM

This nonprovisional application is a continuation of International Application No. PCT/EP2018/077144, which was filed on Oct. 5, 2018, and which is herein incorporated by reference.

BACKGROUND OF THE INVENTION

Field of the Invention

The present invention relates to a modular lighting system, especially for being mounted to a vehicle, a plane, a boat or a building, and in particular to a modular lighting system, comprising a control PCB, an LED and a housing with a housing base. Moreover, the invention is directed to a method for manufacturing a generically modular lighting system.

Description of the Background Art

Lighting systems are used in various technical fields, e. g. on vehicles, planes, ships, buildings or the like. There is a large scale of different functions and assignments for lighting systems. Beacons are determined to draw attention to an occurring event, such as the approach of an ambulance, the closing of an automatic gate or the like, in order to improve the process of the event and in order to prevent accidents. Therefore, a main function of beacons is a hazard warning lamp. Other lighting possible functions of the lightning system are headlights, turn signals, rear lights, brake lights, marker lights, skylights or the like.

Modern lighting systems comprise a PCB (printed circuit board) on which at least one LED (light emitting diode) is mounted. Usually, die PCB is attached to a base of the lighting system, wherein the at least one LED is attached to the PCB in a way for emitting most of the light in a direction perpendicular to the PCB. Depending on the particular design, modern lighting systems comprise collimators and/or lenses of different sizes and shapes as well as various different electronic parts.

Modern lighting systems have the disadvantage that for each lighting system size and different lighting system functions, a complete new lighting system design is required, comprising a special designed PCB, different types of LED, various optical and electronic parts that have to be attached to the PCB. Thus, part management is very complex and expensive due to storage and handling costs. Furthermore, assembly of these parts is very complex and time-consuming. Every part of the lightning system must be constructed again only with the sole purpose to be integrated in only one type of product for only one size, with high costs, in order to spread the light in the desired directions and to meet legal requirements.

SUMMARY OF THE INVENTION

It is therefore an object of the present invention to provide a lighting system, especially for vehicles, planes, ships, buildings or the like, and a method for manufacturing a lighting system that do not show or at least improve the aforementioned drawbacks. In particular, it is an object of the present invention, to provide a lighting system that is easy to manufacture at reduced or at least relatively moderate production costs. Beyond that, it is a particular object of the present invention, to provide a method for manufacturing a lighting system that enables an easy assembly with reduced or at least relatively moderate production costs. Another particular object of present invention is to provide a way to use the modular system in any shape and form lamp without the need to redesign and reconstruct the whole optic system of any lamp.

According to an exemplary embodiment of the invention, the problem is solved by a modular lighting system, comprising a control PCB, an LED and a housing with a housing base. According to the invention, the LED is attached to a module PCB, wherein the LED and the module PCB are part of an LED module, wherein the module PCB is electrically connected to the control PCB. The modular lighting system can be a beacon, headlight, turn signal, rear light, brake light, marker light, skylight or the like. The control PCB can be a control unit to whom the LED modules are attached.

The LED and the module PCB are part of the LED module. The LED is attached to the module PCB and by these means (wires and/or connectors) is electrically connected to the module PCB. The LED module is configured for being preassembled in a preassembly step. Thus, the LED module is easy to handle and can be temporarily stored or directly provided to final assembly of the modular lighting system. Preferably, the LED module is manufactured in a way that the module PCB and the LED are protected from environmental influences, especially from dust, water, mechanical impacts or the like. This can be achieved by usage of specific materials, seals or the like. Moreover, the LED module can comprise a module interface for establishing the electric connection with the control PCB. The module interface can comprise a male connector, a female connector, a cable, a pin or the like or a combination thereof.

The LED module is electrically connected to the control PCB, especially via the module interface. Therefore, it is preferred that the control PCB comprises a PCB interface for connecting the control PCB to the LED module, especially to the module interface of the LED module. The PCB interface can comprise a male connector, a female connector, a cable, a pin or the like or a combination thereof.

The modular lighting system has the advantage over conventional lighting systems that it is has a less complex design and, therefore, it is very easy to assemble. Since the LED module can be used for a huge variety of different modular lightning systems, the amount of parts for manufacturing different sized and shaped lightning systems or lightning systems with different functions or colors can be reduced significantly.

Another advantage of the LED module is that it can be tested for product quality separately without being attached to the control PCB. In case a faulty LED module is detected, just the faulty LED module has to be disposed without affecting assembly of the control PCB with the LED modules. This enables mass production of the modular lighting system with increased production speed, improved product quality at relatively low production costs.

The present invention permits a considerable degree of flexibility in setting up the optical system inside any new lightning product using the same components and only changing the mounting position and the number of modules.

It is preferred that the modular lighting system comprises a plurality of LED modules, each LED module comprising an LED assembled to a module PCB, wherein the module PCBs are electrically connected to the control PCB. The LED modules can be of the same design or of different designs, especially with respect to the color of the LED and/or LED module specific light effects. Furthermore, it is preferred that the control PCB comprises at least one PCB interface for each LED module. The LED modules can be arranged within the modular lighting system, especially at the control PCB and/or the housing base of the modular lighting system in an arbitrary order.

The LED modules can be arranged in a way to simulate a single LED module. It is preferred that the LED modules are arranged with respect to at least one symmetry plane and/or at least one symmetry axis. By these means, almost any kind of lighting device, e. g. a headlight, a beacon or the like, and with almost any shape, size, light effect or the like, can be achieved with the modular lighting system at relatively low cost.

The housing base can comprise a plurality of LED module seats for attaching the LED modules to the housing base.

The LED module seats can be configured for form fit alignment of the LED modules. Thus, the assembly of the LED modules is improved. Moreover, this has the advantage that the LED modules can be easily secured to the housing base, especially to the respective LED module seat, and/or the control PCB, especially by means of a screw, clip, solder or the like.

At least one LED module can comprise an optical housing, wherein the optical housing comprises a lens and/or a collimator. The optical housing is preferably designed to protect the LED from at least one side, especially a major light emitting side of the LED. More preferred the optical housing is designed to protect the LED from other sides. It is preferred that the optical housing is made of a waterproof and/or shockproof material. The optical housing comprises a translucent, especially a transparent, material, to improve light transmission. Preferably, the optical housing comprises PMMA 8N or the like. Likewise preferred, the optical housing consists of or at least comprises a flexible optical material. This can increase the protection from mechanical impacts. The optical housing is preferably configured for guiding light emitted by the LED in one main emission direction. Furthermore, the optical housing may comprise pillow optics on an outside surface, facing away from the LED, for generating special lighting effects. It is preferred that within the optical housing, adjacent to the LED, a mirror optics, especially a concave mirror optic for guiding light emitted by the LED in the main emission direction is installed. An optical housing has the advantage that the LED can be protected from environmental influences and that various light effects can be created by means of the design of the optical housing.

At least one LED-module can comprise a module base, wherein the module base and the optical housing are aligned with each other in a way to constitute a fully sealed module interior of the LED-module, wherein the LED and the module PCB are located within the fully sealed module interior. Preferably, the optical housing is directly mounted to the housing base with or without an intermediate seal, gasket or the like. Alternatively, at least one intermediate housing part, such as a side wall, heatsink or the like, can be arranged in between the module base and the optical housing. The module base and the optical housing are preferably arranged and secured to each other or further housing parts in a way that an interior of the LED module is sealed from the environment and, therefore, protected from environmental influences, such as water, mechanical impacts or the like. This has the advantage that storage and handling of the LED module is improved, since less precaution is needed due to the robust design of the LED module At least one LED module can comprise an LED driver for driving the LED and a heatsink for cooling the module PCB and/or the LED and/or the LED driver, wherein the LED module comprises a thermal pad, arranged in close contact in between the module PCB and the heatsink, wherein the thermal pad is an electric isolator and/or a heat conductor. Preferably, the thermal pad is an electric isolator and a heat conductor. It is further preferred that the housing base comprises a heatsink, wherein, in an assembled state of the LED module at the housing base, the heatsink of the LED module is in contact with the heatsink of the housing base. This can be in direct contact or by means of an intermediate heat conductive material. By these means, heat generated by the LED module can be easily transferred to an outside of the modular lighting system. An integration of the LED driver into the LED module has the advantage that the LED module is provides as independent functional group, just needing electricity for operation. The LED module itself, if it has more than 2 wires (presently it can have up to 4), can be configured to accept commands to turn on and turn of in a pattern for example, and can give feedback for example if a fault is present. These are important features for functional safety purposes and the realization of the different functions inside a lamp. The LED module is a "smart" module. Thermal pads at the heatsink have the advantage that heat transfer can be improved.

The control PCB can comprise a first connector and the module PCB comprise a second connector, wherein the first connector and the second connector are configured for connecting the control PCB to the module PCB directly or by means of a harness of the modular lighting system. Connectors have the advantage that assembly of the LED module to the control PCB is improved. Furthermore, replacement of the LED module, e. g. due to a faulty LED module or the need for a different light effect, is improved.

The housing can comprise a housing cover, wherein the housing cover and the housing base are aligned with each other in a way to constitute a sealed housing interior, wherein the LED modules and the control PCB are located within the sealed housing interior. For constituting the sealed housing interior, extra housing parts, such as rings, seals, housing walls or the like can be part of the modular lighting system. For better temperature regulation, a venting element can be provided at the housing, especially at the housing base. The venting element is preferably configured to allow air exchange between an interior of the housing and e surrounding environment. The housing cover is preferably made of or at least comprises a translucent, especially transparent, material for allowing light emitted by the LED to pass through. It is preferred that the housing cover is made of a waterproof and/or shockproof material. Such housing has the advantage that the modular lighting system is very robust and provides improved protection for its electronic components against environmental influences. Beyond that, the LED and the module PCB are provided with a double protection, namely by the module housing and the surrounding housing.

According to a second aspect of the invention, the problem is solved by a method for manufacturing an inventive modular lighting system. The method comprises the following steps: providing at least one LED module of the modular lighting system by assembling at least one LED to a module PCB, assembling the module PCB to a module base, fixing an optical housing to the module base in a way to constitute a fully sealed module interior, wherein the LED and the module PCB are located within the fully sealed module interior; attaching the at least one LED module to a housing base of the modular lighting system; and connecting the at least one LED module with a control PCB of the modular lighting system.

Firstly, the LED module is assembled. This includes the assembly of the LED to the module PCB, especially by solder. The module PCB is assembled and preferably fixed, e. g. by screwing, clicking, gluing or the like, onto the module base. Preferably, the module base is configured to provide a form fit for the module PCB. Thus, a correct alignment of the module PCB to the module base is achievable easily. Then, the optical housing is aligned with the module base and the LED in a way that the LED has a desired relative position and orientation to the optical housing for achieving desired light effects and that the interior of the LED module is surrounded by the module base and the optical housing. By means of a seal or the like, that is arranged between the module base and the optical housing, the fully sealed module interior of the module is sealed from environmental influences. Thus, the LED and the module PCB are protected from environmental influences. The manufactured LED module can be temporarily put on stock or provided for the next manufacturing steps. In the following manufacturing steps, the LED module is attached to the housing base of the modular housing system and electrically connected to the control PCB of the modular lighting system. Preferably, a plurality of LED modules is attached to the housing base and electrically connected to the control PCB. It is preferred that the LED modules are fixed onto the housing base, especially be screwing, clicking, gluing or the like.

The method for manufacturing a modular lighting system according to the second aspect of the invention shows the same advantages as the modular lighting system according to the first aspect of the invention. Therefore, the inventive method has the advantage over conventional methods that it is especially suitable for manufacturing lighting systems that have a less complex design. The method provides simple assembly steps. Since the LED module can be used for a huge variety of different modular lightning systems, the amount of parts for manufacturing different sized and shaped lightning systems or lightning systems with different functions or colors can be reduced significantly. Another advantage of the inventive method is that it generates an intermediate product, namely the LED module. The LED modules can be tested for product quality separately without being attached to the control PCB. In case a faulty LED module is detected, just the faulty LED module has to be disposed without affecting assembly of the control PCB with the LED modules. This enables mass production of the modular lighting system with increased production speed, improved product quality at relatively low production costs.

A housing cover of the housing can be fixed to the housing base in a way to constitute a sealed housing interior, wherein the LED module and the control PCB are located within the sealed housing interior. The housing cover can be fixed to the housing base directly or with intermediate housing parts, seals or the like. The housing cover is preferably made of or at least comprises a translucent, especially transparent, material for allowing light emitted by the LED to pass through. Preferably, the housing cover is made of a waterproof and shockproof material. This has the advantage that the LED modules are better protected from environmental influences, such as rain, mechanical impacts or the like.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein:

FIGS. 4.1 to 4.4 show schematic circuit diagrams of a module control unit of the control PCB.

DETAILED DESCRIPTION

Figure 1:
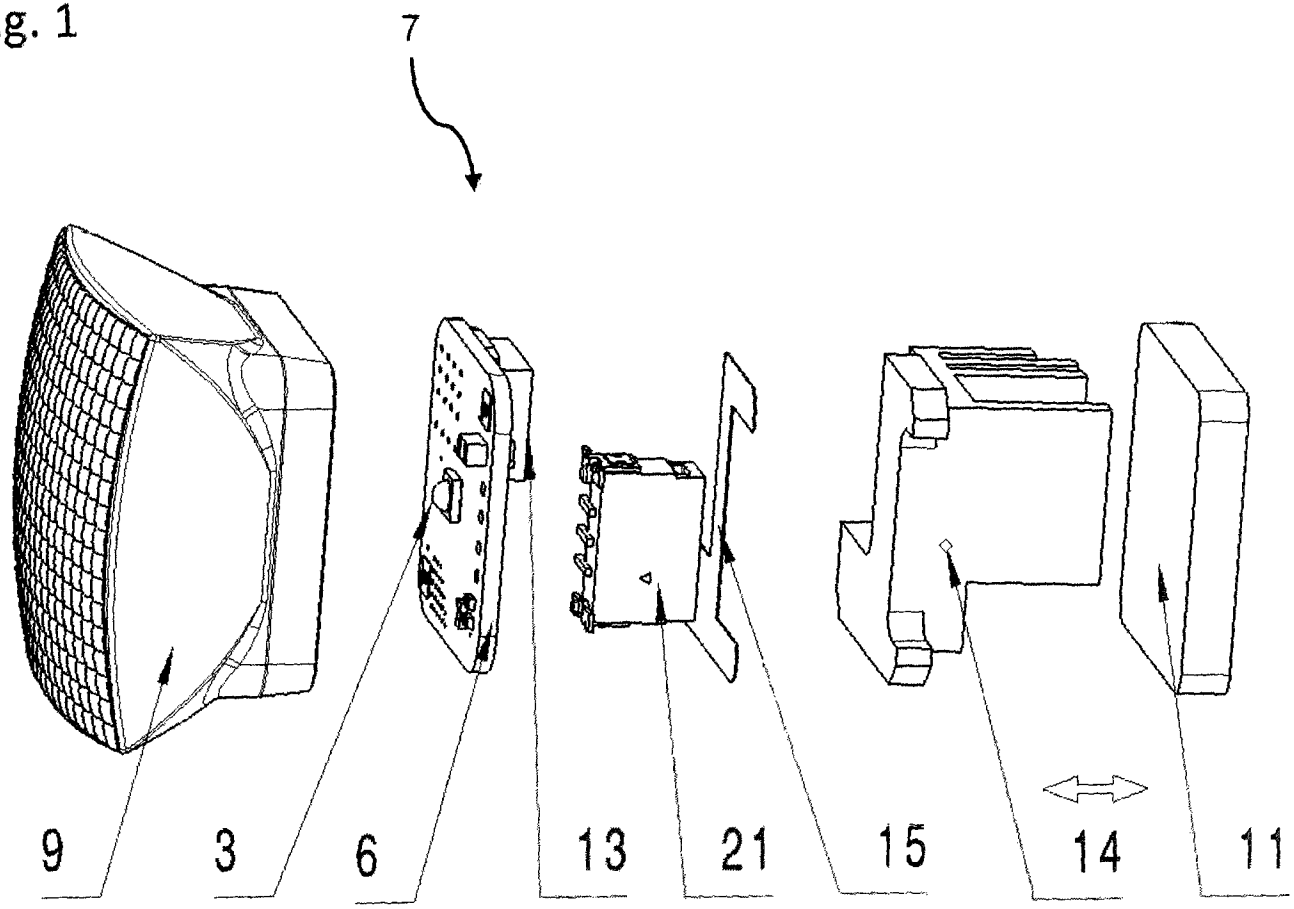
FIG. 1 is a schematic exploded side view of a preferred embodiment of an LED module.
Figure 6:
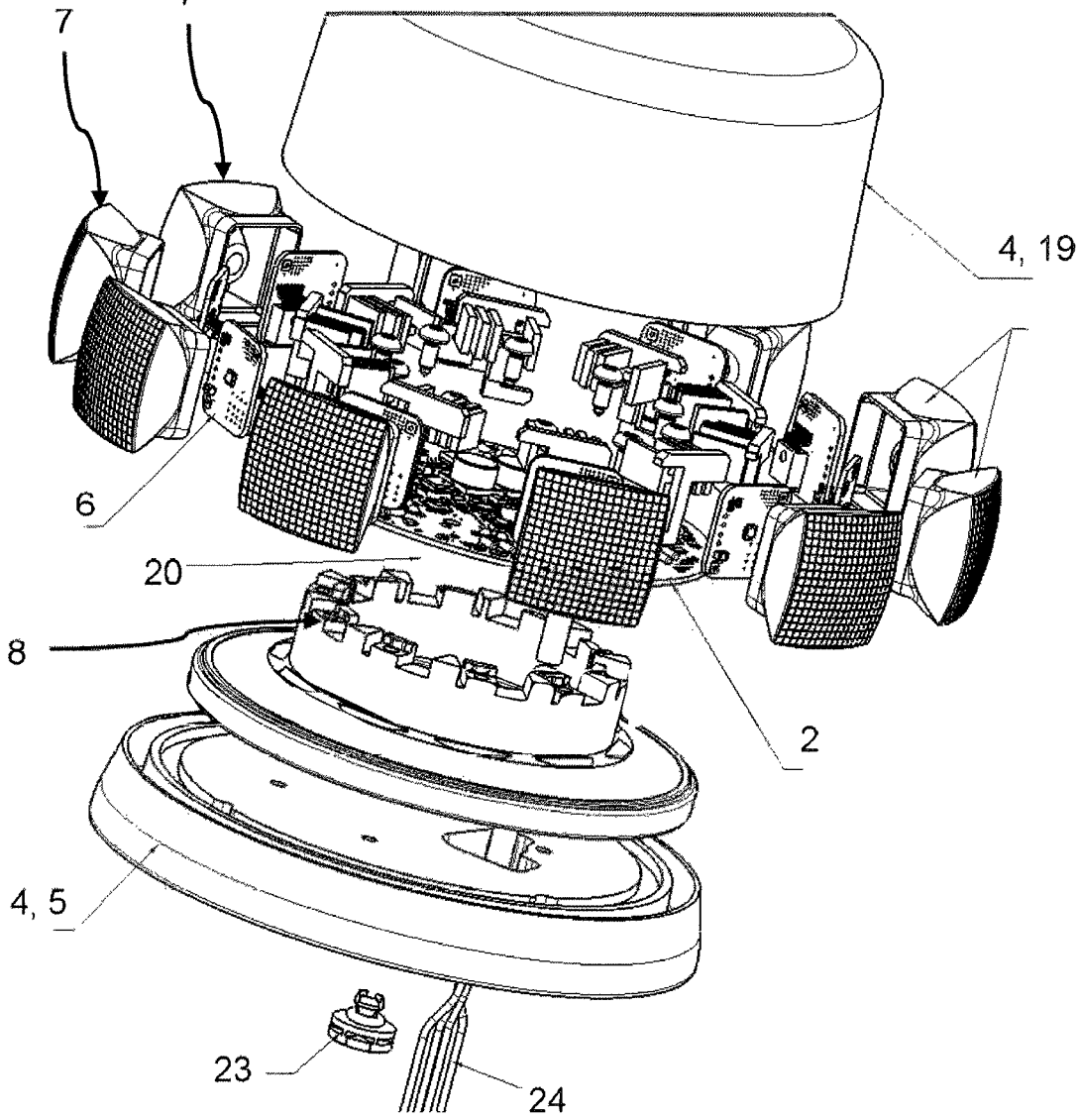
FIG. 6 is a schematic exploded perspective view of an exemplary embodiment of a modular lightning system according to the invention.

In FIG. 1, an LED module 7 of a modular lighting system 1 according to the invention (c. f. FIG. 6) is shown in a schematic exploded side view.

The LED module 7 comprises an optical housing 9, which will be described in detail with respect to FIG. 2. An LED 3 is located at a module PCB 6, facing the optical housing 9. On the opposite side of the module PCB 6, an LED driver 13 for driving the LED 3 and other electronic parts 21 are located for being attached to the module PCB 6. An thermal pad 15 is located between the module PCB 6 and a heatsink 14 for providing improved thermal conductivity and electric insulation. Moreover, the LED module 7 comprises a module base 11 for being attached to the optical housing 9, thus protecting the electronic components of the LED module 7 from environmental influences. The module base 11 can comprise glue that is poured over the back PCB and around the heatsink realizing the seal and mechanic attachment between heatsink PCB and housing (lens).

Figure 2:
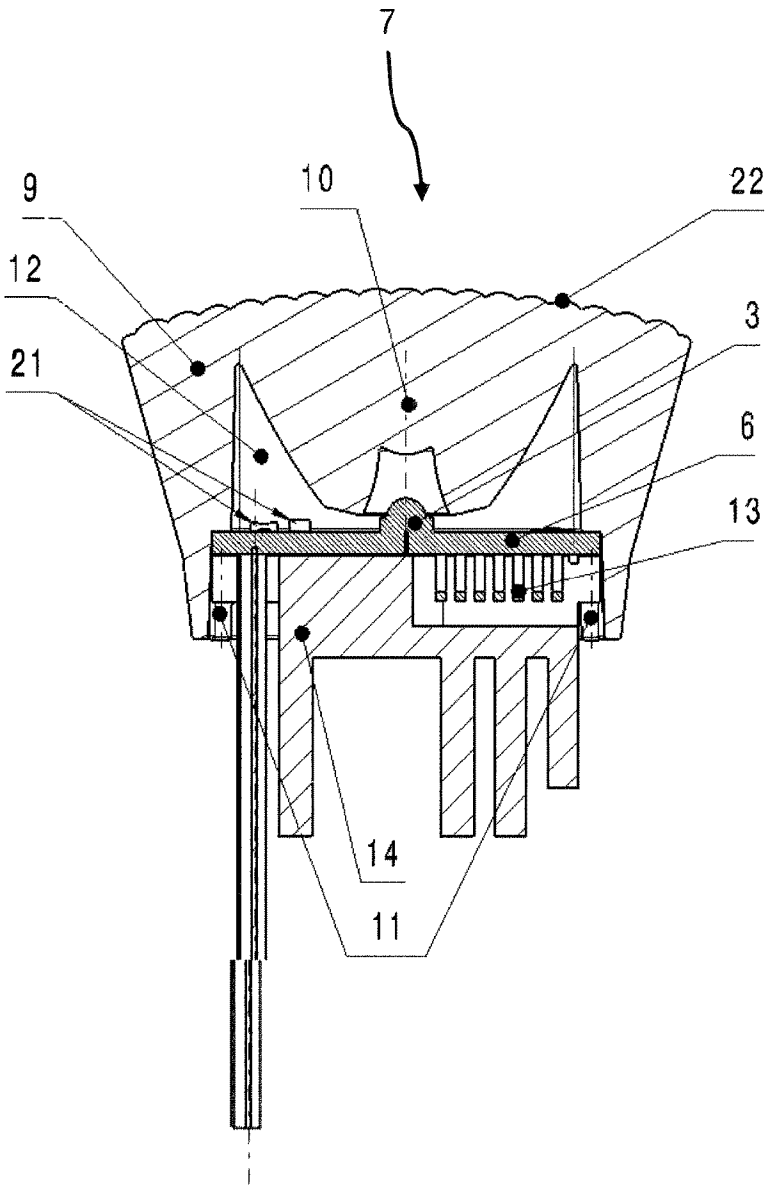
FIG. 2 is a schematic sectional side view of the LED module of FIG. 1.

FIG. 2 shows the LED module 7 of FIG. 1 in a schematic sectional view. The optical housing 9 comprises on an outer surface pillow optics 22 for creating a specific lighting effect. The pillow optics 22 are located on an outer surface of the optical housing 9 that is facing away from the module PCB 6 and the module base 11, in particular glue. Furthermore, the optical housing 9 comprises a collimator 10 for guiding light emitted by the LED 3 in a direction substantially perpendicular to the module PCB 6. The module base 11 and the optical housing 9 are attached to each other, thus constituting a fully added fully sealed module interior 12, wherein the module PCB 6 and the LED 3 are located within the fully sealed module interior 12. The module base 11 can comprise glue that is poured over the back PCB and around the heatsink realizing the seal and mechanic attachment between heatsink PCB and housing (lens).

Figure 3:
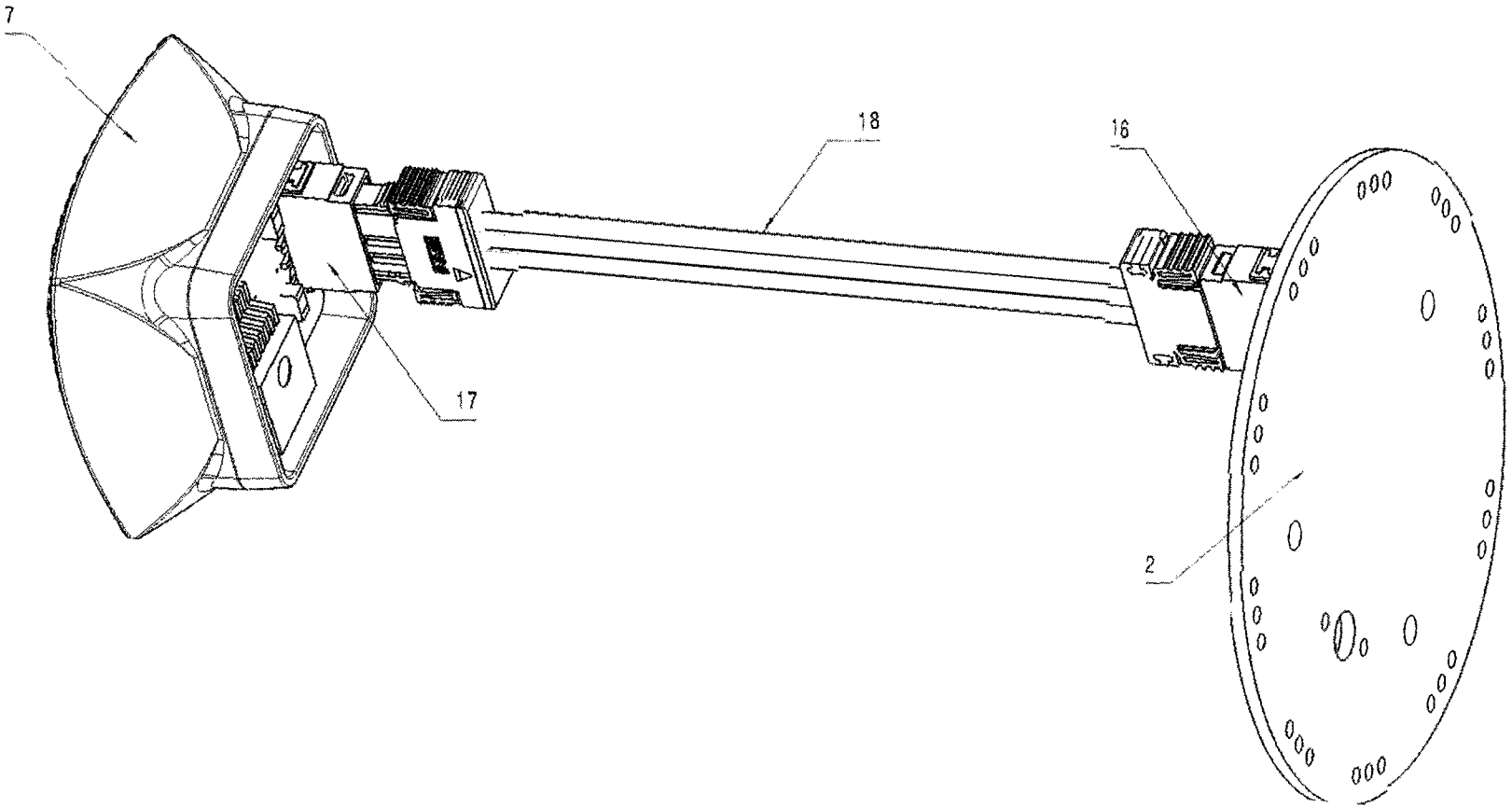
FIG. 3 is a schematic perspective view of the attachment of the LED module to a control PCB.

In FIG. 3, an attachment of an LED module 7 to a control PCB 2 of the modular lighting system 1 (c. f. FIG. 6) is shown a schematic perspective view. In this example, the control PCB 2 comprises a first connector 16. The LED module 7 comprises a second connector 17, attached to the module PCB 6 (c. f. FIG. 1) of the LED module 7. The first connector 16 is electrically and mechanically connected to a first end of a harness 18 and the second connector 17 is electrically and mechanically connected to a second end of the harness 18. By these means, the LED module 7 is electrically coupled to the control PCB 2.

FIGS. 4.1 to 4.4 show a module control unit 25 of the control PCB 2 in a schematic circuit diagram. The module control unit 25 is configured for controlling a plurality of LED modules 7.

Figure 5:
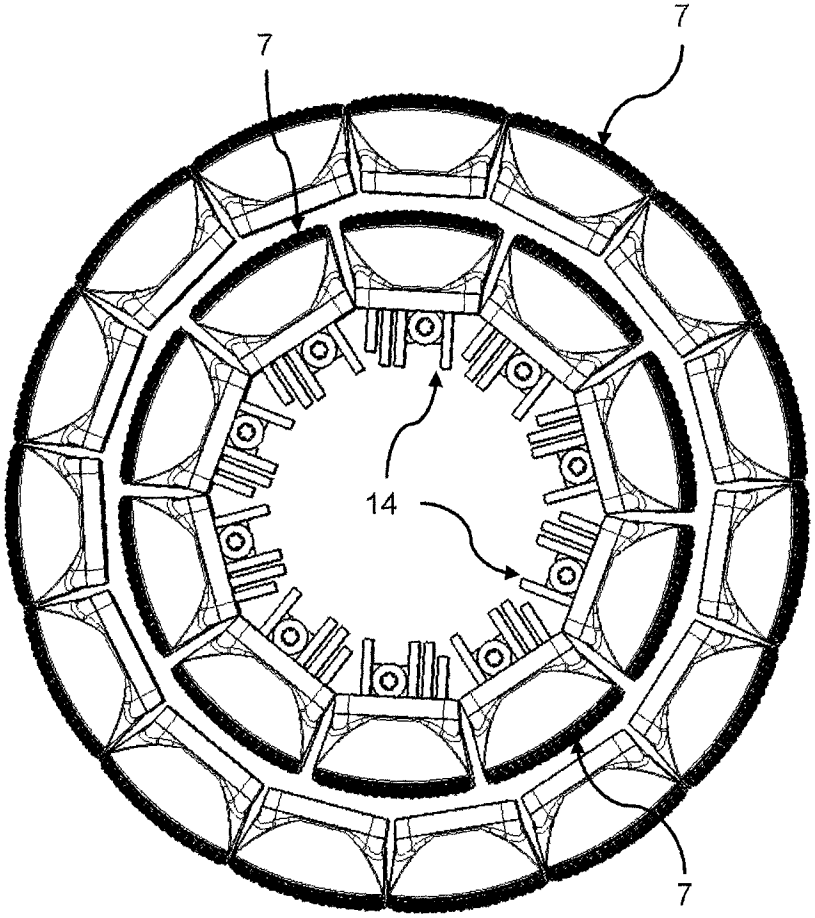
FIG. 5 is a schematic top view of two different arrangements of LED modules in one Figure.

In FIG. 5, two different arrangements of LED modules 7 are illustrated in a schematic top view. A first series of ten LED modules 7 are arranged in an inner circle. The heatsink 14 and the second connector 17 are illustrated for one LED module 7, only. A second series of fourteen LED modules 7 are arranged in an outer circle. This Figure shows that the modular lighting system 1, according to the invention, has a high flexibility with respect to different product sizes. For a huge variety of product sizes, the same LED modules 7 can be used.

FIG. 6 shows a preferred first embodiment of a modular lightning system 1 according to the invention in a schematic exploded perspective view. The modular lighting system 1 comprises a housing 4 with an opaque housing base 5 and a transparent or translucent housing cover 19. The housing cover 19 and the housing base 5 are configured for being attached to each other, thereby constituting a sealed housing interior 20. At the housing base 5, a main connector 24 for connecting the modular lighting 1 system to a control unit, a power source or the like and a venting element 23 are provided. On a side facing the housing cover 19, the housing base 5 comprises a plurality of LED module seats 8, each configured for hosting an LED module 7. The LED modules 7 are arranged in a circular way. The module PCBs 6 of the LED modules 7 are connected to the control PCB 2. In mounted state, the LED modules 7 and the control PCB 2 are located within the housing interior 20, thus being protected from environmental influences.

Figure 7:
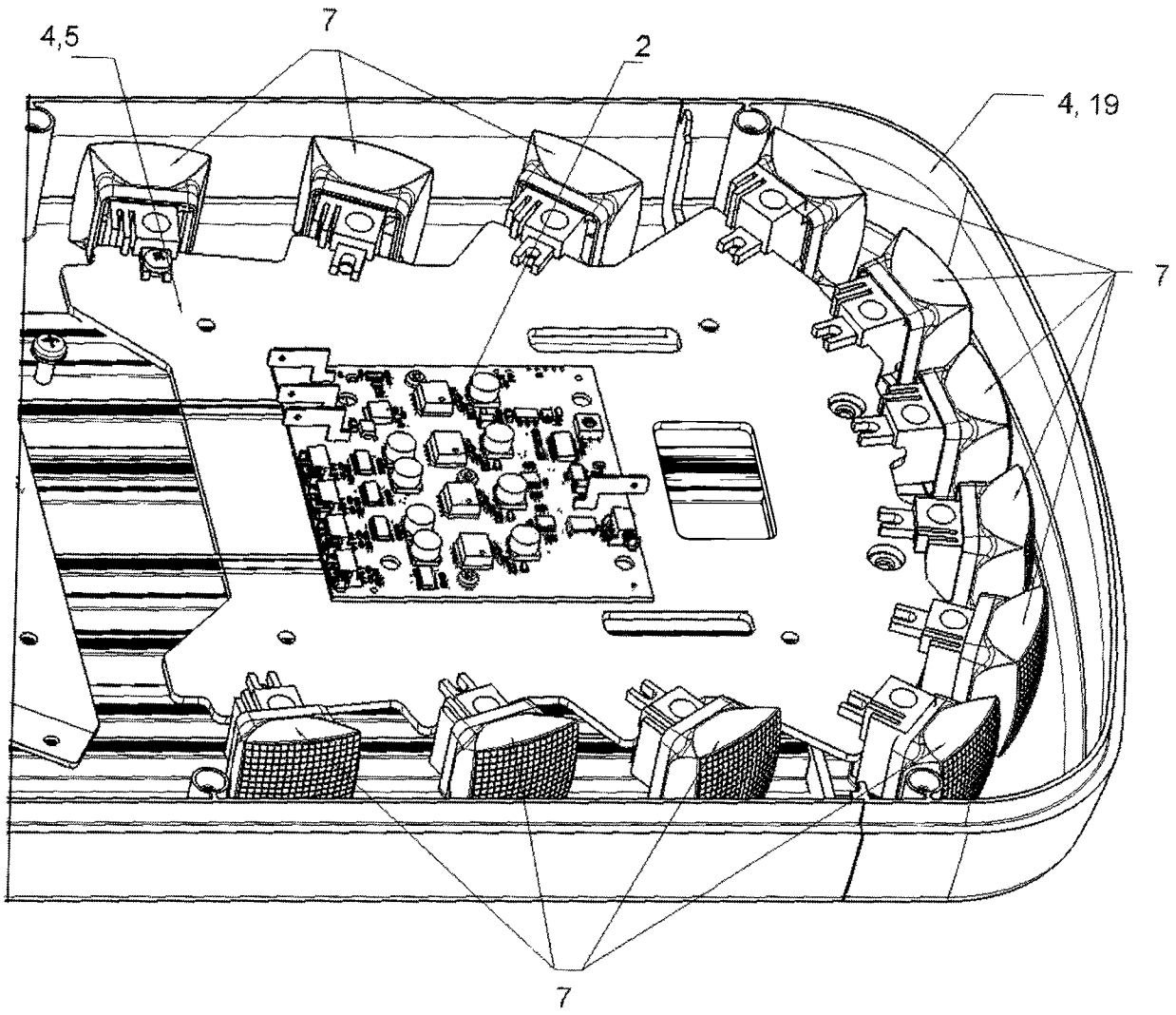
FIG. 7 is a schematic sectional view of an exemplary embodiment of a modular lightning system according to the invention.

FIG. 7 shows a modular lightning system 1 according to the invention in a schematic sectional perspective view. The LED modules 7 are attached to the housing base 5 of the housing 4 with a different alignment as in FIG. 6. Just a part of the housing cover 19, covering the LED modules 7 from one side, is illustrated. The control PCB 2 is mounted onto the housing base 5.

Figure 8:
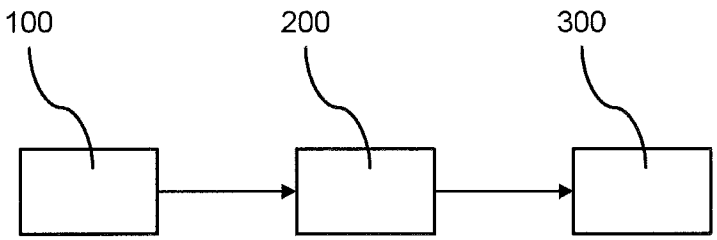
FIG. 8 is a flow chart of a preferred embodiment of the method according to the invention.

FIG. 8 shows a preferred embodiment of the method according to the invention in a schematic flow chart. In a first step 100, at least one LED module 7 of the modular lighting system 1 is provided. In this matter, an LED 3 is assembled to a module PCB 6, the module PCB is assembled to a module base 11, and an optical housing 9 is fixed to the module base 11 in a way to constitute a fully sealed module interior 12.

The LED 3 and the module PCB 6 are located within the fully sealed module interior 12. In a second step 200, the at least one LED module 7 is attached to a housing base 5 of the modular lighting system 1. In a third step 300, the at least one LED module 7 is connected with a control PCB 2 of the modular lighting system.

Figure 9:
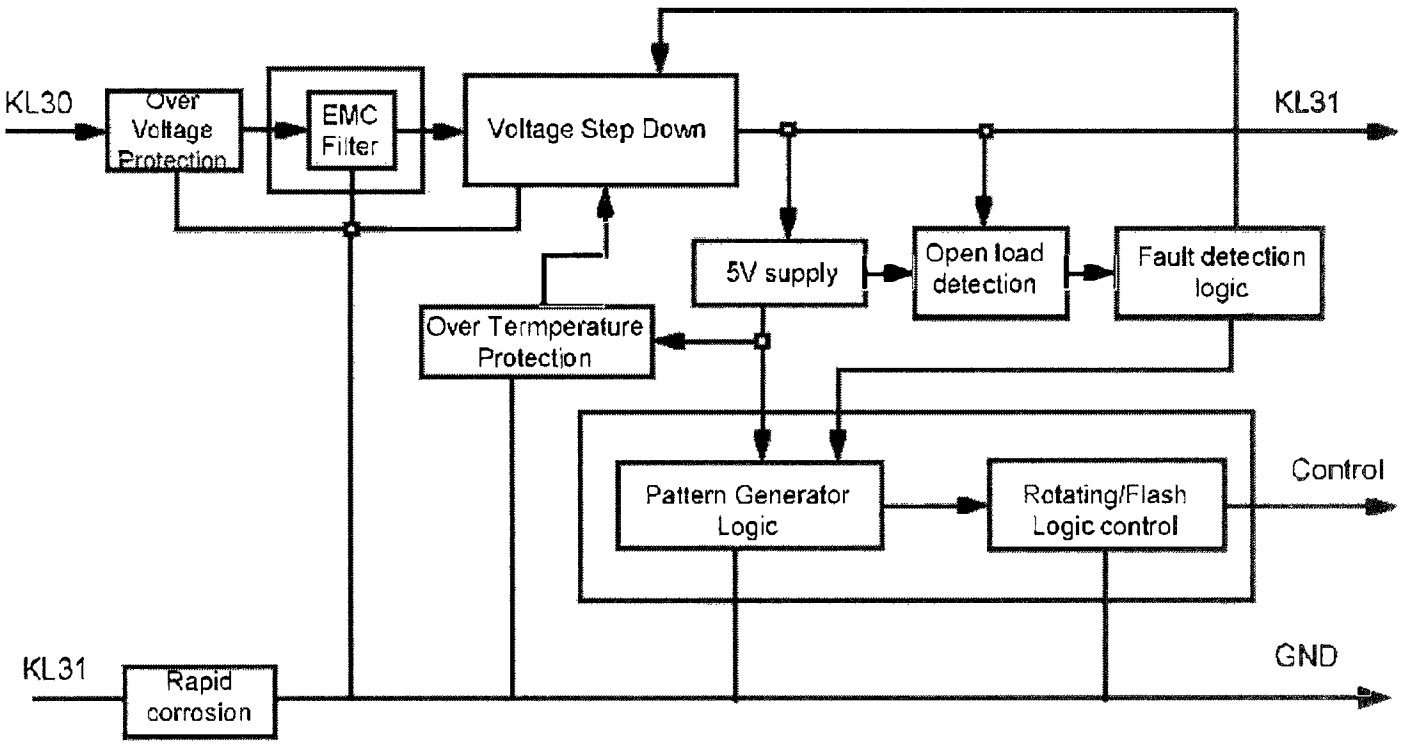
FIG. 9 is a module control unit-diagram block.

FIG. 9 shows a module control unit-diagram block. The characteristics of the control unit are: Over Voltage Protection—protect the MCU and MLx; Voltage Step Down-provide supply for MLx modules; Over Temperature Protection—to manage thermal management; Rapid corrosion—short circuit protection; 5V supply—provide supply for OLD, FDL, PGL and R/F LC; Open Load Detection—detect if one MLx fail; Fault Detection Logic—shutdown VSD&PGL; Pattern Generator Logic—generate patens for MLx; and Rotating/Flash Logic control—manage the signal distribution to MLx correspondence.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A modular lighting system comprising:

a control PCB;

a plurality of LED modules; and a housing with a housing base and a housing cover, wherein each of the plurality of LED modules include an LED and a module PCB, with the LED being attached to the module PCB and the module PCB being electrically connected to the control PCB, wherein the housing base comprises a plurality of LED module seats for attaching each of the plurality of LED modules to the housing base, wherein the housing cover and the housing base are aligned with and connected to each other to constitute a sealed housing interior, wherein the plurality of LED modules and the control PCB are located within the sealed housing interior, wherein at least one of the plurality of LED modules comprises an optical housing, and wherein the at least one of the plurality of LED modules comprises a module base, wherein the module base and the optical housing are aligned with and connected to each other to constitute a fully sealed module interior, wherein the LED and the module PCB of the at least one of the plurality of LED modules are located within the fully sealed module interior.

2. The modular lighting system according to claim 1, wherein the optical housing comprises a lens and/or a collimator.

3. The modular lighting system according to claim 1, wherein at least one of the plurality of LED modules comprises an LED driver for driving the LED and a heatsink for cooling the module PCB and/or the LED and/or the LED driver, wherein a thermal pad is arranged in contact in between the module PCB and the heatsink, and wherein the thermal pad is an electric isolator and/or a heat conductor.

4. The modular lighting system according to claim 1, wherein the control PCB comprises a first connector and the module PCB of each of the plurality of LED modules comprises a second connector, and wherein the first connector and the second connector are configured for connecting the control PCB to the module PCB of each of the plurality of LED modules directly or via a harness of the modular lighting system.

5. A method for manufacturing a modular lighting system, the method comprising:

providing a plurality of LED modules of the modular lighting system by assembling at least one LED to a module PCB;

assembling the module PCB to a module base;

fixing an optical housing to the module base to constitute a fully sealed module interior, with the at least one LED and the module PCB being located within the fully sealed module interior;

attaching a control PCB of the modular lighting system and the plurality of LED modules to a housing base of a housing of the modular lighting system; and connecting the plurality of LED modules with a control PCB of the modular lighting system, wherein the housing base of the housing has a plurality of LED module seats and the plurality of LED modules are attached to a respective one of the plurality of LED module seats, and wherein a housing cover of the housing is fixed to the housing base to constitute a sealed housing interior, wherein the plurality of LED modules and the control PCB are located within the sealed housing interior.

6. The modular lighting system according to claim 1, wherein the control PCB is attached to the housing base.

7. The modular lighting system according to claim 1, wherein the housing base is opaque and the housing cover is translucent or transparent.

8. The method according to claim 5, wherein the housing base is opaque and the housing cover is translucent or transparent.

* * * * *